United States Patent [19]

Feaver et al.

[11] Patent Number: 4,890,934

[45] Date of Patent: Jan. 2, 1990

[54] PLASTIC CARRIER BAG WITH CUT-OUT CARRY HANDLE

[75] Inventors: Francis R. Feaver, Burlington; Walter K. Teetzel, Ancaster, both of Canada

[73] Assignee: The Procter & Gamble Company, Cincinnati, Ohio

[21] Appl. No.: 264,284

[22] Filed: Oct. 28, 1988

[30] Foreign Application Priority Data

Oct. 30, 1987 [CA] Canada ..... 551572

[51] Int. Cl.[4] ..... B65D 33/08

[52] U.S. Cl. ..... 383/10; 383/37; 383/120; 206/554

[58] Field of Search ..... 383/10, 37, 120; 206/554

[56] References Cited

U.S. PATENT DOCUMENTS

| | | | |
|---|---|---|---|
| 3,378,189 | 4/1968 | Dickson | 383/120 X |
| 3,497,130 | 3/1970 | Stahl | 383/10 |
| 3,514,033 | 5/1970 | Goodwin | 383/10 |
| 4,252,269 | 3/1981 | Peppiatt | 383/10 X |
| 4,524,459 | 6/1985 | Titchenal | 383/37 |
| 4,539,705 | 9/1985 | Baines | 383/120 X |
| 4,550,439 | 10/1985 | Peppiatt et al. | 383/120 X |
| 4,691,368 | 9/1987 | Roessiger | 383/10 |
| 4,769,125 | 9/1988 | Roen et al. | 383/10 X |

FOREIGN PATENT DOCUMENTS

| | | | |
|---|---|---|---|
| 1273157 | 5/1972 | United Kingdom | 383/10 |
| 1280224 | 7/1972 | United Kingdom | 383/10 |
| 1315262 | 5/1973 | United Kingdom | 383/10 |
| 2171077 | 8/1986 | United Kingdom | 383/10 |

*Primary Examiner*—Stephen Marcus
*Assistant Examiner*—K. M. Stemann
*Attorney, Agent, or Firm*—Monte D. Witte; Thomas H. O'Flaherty; Richard C. Witte

[57] ABSTRACT

A carrier bag of heat-sealable plastic film has a front panel joined along side edges by weld lines to a rear panel. The top ends of the panels are joined by an inwardly foldable gusset which is integral in one piece with the panels. The gusset is joined at the ends to the weld lines such that when the bag is in expanded position, the gusset opens to form a top panel of the bag with inner triangular gussets at the ends thereof lying adjacent double-layer triangular film portions joined through the apexes thereof by the weld lines. A cut-out handle for the bag is formed in one of these double-layer triangular portions. The handle may be further reinforced by joining the two film layers of the double-layer portion by means of a V-shaped weld line having the apex on a side edge weld line and extending upwardly on each side of the cut-out handle.

3 Claims, 1 Drawing Sheet

PLASTIC CARRIER BAG WITH CUT-OUT CARRY HANDLE

BACKGROUND OF THE INVENTION

This invention relates to plastic carrier bags and the production thereof.

Plastic carrier bags are now widely used for the storage and shipping of many different types of merchandise. For instance, disposable diapers are typically packed in large plastic bags. Such packages can become quite heavy and the arrangement of a handle which does not tear away from the package can be a problem.

Various solutions to this have been proposed such as those shown in U.S. Pat. Nos. 4,252,269 and 4,550,439. The present invention is directed to a simplified method for providing a strong handle for such bags.

SUMMARY OF THE INVENTION

The present invention is directed to a carrier bag of heat-sealable plastic film having a front panel joined along side edges by weld lines to a rear panel. An opening is provided at the bottom end of the panels and an inwardly foldable gusset is integral in one piece with and joins the top ends of the panels. This gusset is joined at the ends thereof to the weld lines such that when the bag is in collapsed position, the gusset lies flat with the panels and weld lines and when the bag is in the expanded position, the gusset opens to form a top panel of the bag with inner triangular gussets at the ends thereof lying adjacent double-layer triangular film portions joined through the apexes thereof by the weld lines. A cut-out handle for the bag is formed in one of the double-layer triangular portions.

This double-layer triangular portion provides a very strong handle mounting and this handle area may be further strengthened by joining the two film layers adjacent the handle by means of a V-shaped weld line having the apex on a side edge weld line and extending upwardly on each side of the cut-out handle. The cut-out handle design of this invention has the advantage of low cost in that no additional film is required beyond that which is necessary to form the bag.

One preferred form of the bag and the method of producing it will now be described by way of example with reference to the accompanying drawings, in which.

DESCRIPTION OF THE PREFERRED EMBODIMENTS

Figure 1:
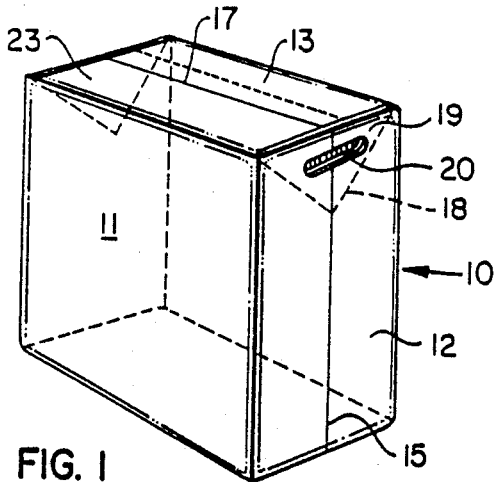
FIG. 1 is a perspective view of the bag in expanded position.
Figure 2:
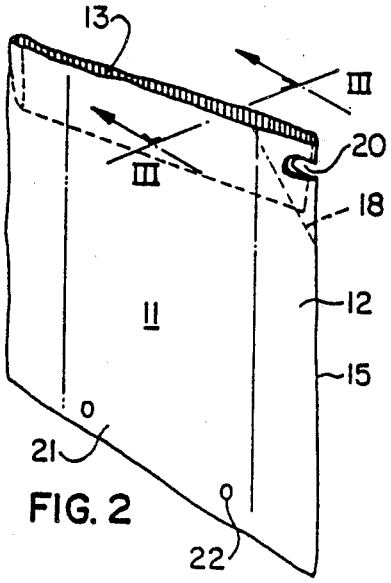
FIG. 2 is a perspective view of the bag in substantially collapsed position.

Referring to the drawings in detail, there is shown a package designated generally as 10 formed of a front panel 11 and a rear panel 14 joined at their side edges by welds 15 and 16.

Figure 3:
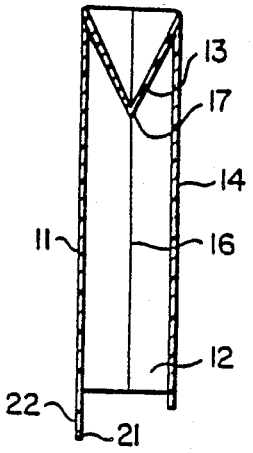
FIG. 3 is a sectional view taken along line III—III in FIG. 2.

A gusset 13 joins the top ends of panels 11 and 14 and this gusset is integral in one piece with the panels. The gusset has a fold line 17 whereby it folds inwardly as shown in FIG. 3. In the fully collapsed position, the two halves of the folded gusset 13 are joined to the weld lines 15 and 16 such that in the collapsed position the gusset lies flat with the panels and the weld lines. Then, when the bag is opened into the expanded position as shown in FIG. 1, the gusset opens to form the top panel of the bag with inner triangular gussets 23 at the ends lying adjacent double-layer triangular film portions 19 joined through the apexes thereof by the weld lines 15 and 16. A cut-out handle 20 is provided for the bag in one of the double-layer triangular portions 19.

The area surrounding the handle 20 may be further reinforced by joining the two film layers of the double-layer triangular portion 19 by means of a V-shaped weld line 18. This weld line 18 has the apex thereof on the side edge weld line and extends upwardly on each side of the cut-out handle 20.

The bag may be made from many of a wide variety of heat-sealable polymeric plastic films such as polyethylene, polypropylene, polyvinyl chloride, etc. The bags may be easily formed by folding a heat-sealable plastic film on itself and shaping along one side to form gusset 13. With the film lying flat in this folded position, the side edges are provided with the heat seals 15 and 16. Next, a welding head is used to provide the V-weld 18 and finally, the cut-out handle 20 is cut from the material. The film used may be in the form of a mono-layer film or in the form of a laminated or multi-layer film.

Panel 11 is shown with a bottom extension 21 provided with holes 22. These holes 22 facilitate holding the bag when it is being filled with articles. After the bag has been filled, any excess material is removed from the bottoms of panels 11 and 14 and the bag is welded closed.

We claim:

1. A carrier bag of heat-sealable plastic film having a front panel joined along side edges by weld lines to a rear panel, an opening at the bottom end of said panels, an inwardly foldable gusset integral in one piece with and joining the top ends of said panels, said gusset being joined at the ends thereof to said weld lines such that in collapsed position the gusset lies flat with the panels and weld lines and in the expanded position the gusset opens to form a top panel of the bag with inner triangular gussets at the ends thereof lying adjacent double-layer triangular film portions joined through the apexes thereof by said weld lines, and a cut-out handle for the bag formed in at least one of said double-layer triangular portions.

2. A carrier bag according to claim 1 wherein the two film layers of the double-layer triangular film portion containing a cut-out handle are further joined by a V-shaped weld line having the apex on a side edge weld line and extending upwardly on each side of the cut-out handle.

3. A carrier bag according to claim 2 wherein one of said panels is longer than the other and has a said of holes therein adjacent said bottom end.

* * * * *

UNITED STATES PATENT AND TRADEMARK OFFICE

CERTIFICATE OF CORRECTION

PATENT NO. : 4,890,934

DATED : January 2, 1990

INVENTOR(S) : Francis R. Feaver and Walker K. Teetzel

It is certified that error appears in the above-identified patent and that said Letters Patent is hereby corrected as shown below:

Col. 2 line 60 "said" should read -- pair --.

Signed and Sealed this

First Day of January, 1991

*Attest:*

HARRY F. MANBECK, JR.

*Attesting Officer*

*Commissioner of Patents and Trademarks*